US005324763A

United States Patent [19]

Rössler et al.

[11] Patent Number: 5,324,763

[45] Date of Patent: Jun. 28, 1994

[54] AGENT FOR THE TREATMENT OF FIBRE MATERIALS

[75] Inventors: Erich Rössler, Stadtbergen-Leitershofen; Belgin Sahin, Augsburg, both of Fed. Rep. of Germany

[73] Assignee: Ciba-Geigy Corporation, Ardsley, N.Y.

[21] Appl. No.: 809,684

[22] Filed: Dec. 17, 1991

[30] Foreign Application Priority Data

Dec. 19, 1990 [DE] Fed. Rep. of Germany ..... 4040641

[51] Int. Cl.[5] ..... C08K 5/00

[52] U.S. Cl. ..... 524/368; 524/375; 524/507; 524/520

[58] Field of Search ..... 524/506, 507, 375, 520, 524/368

[56] References Cited

U.S. PATENT DOCUMENTS

| | | | |
|---|---|---|---|
| 3,462,295 | 8/1969 | Elmquist et al. | 117/143 |
| 3,498,958 | 3/1970 | Ray | 260/78.5 |
| 3,968,066 | 7/1976 | Mueller | 260/29.2 |
| 4,054,592 | 10/1977 | Dear | 560/25 |
| 4,100,340 | 7/1978 | Waldmann | 526/245 |
| 4,504,401 | 3/1985 | Matsuo | 252/8.75 |
| 4,514,537 | 4/1985 | Cavanaugh | 524/520 X |
| 4,582,882 | 4/1986 | Lynn | 526/243 |
| 4,742,140 | 5/1988 | Greenwood et al. | 526/245 |
| 4,812,337 | 3/1989 | Sugimura et al. | 524/520 X |
| 4,877,839 | 10/1989 | Conti-Ramsden et al. | 524/520 X |
| 4,898,981 | 2/1990 | Folk | 568/28 |
| 4,904,726 | 2/1990 | Morgan et al. | 524/520 |
| 5,006,593 | 4/1991 | Brasure et al. | 524/520 |
| 5,019,428 | 5/1991 | Ludemann | 427/387 |

FOREIGN PATENT DOCUMENTS

| | | |
|---|---|---|
| 234724 | 9/1987 | European Pat. Off. . |
| 364772 | 4/1990 | European Pat. Off. . |
| 383310 | 8/1990 | European Pat. Off. . |
| 3834322 | 4/1990 | Fed. Rep. of Germany . |
| 2039746 | 1/1971 | France . |
| 1411104 | 10/1975 | United Kingdom . |

OTHER PUBLICATIONS

Chem. Abst. 113(18):1532792.
Chem. Abst. 74(6):23609x.
Derwent 87-188035/27.
Derwent 87-034106/05.
Derwent 75-20278w/12.
Chem. Abstract 113(18) 153279.

*Primary Examiner*—Judy M. Reddick
*Attorney, Agent, or Firm*—Kevin T. Mansfield; Edward McC. Roberts

[57] ABSTRACT

Highly effective agents for the water and oil repellent finishing of fibrous, in particular textile materials contain at least two components which are aqueous dispersions. One of the dispersions contains a copolymer of a fluorine-containing (meth)acrylate, vinyl chloride and a fluorine-free (meth)acrylate, and also ethoxylated alkylphenol. The other dispersion contains either a copolymer of a fluorine-containing acrylate, vinylidene chloride and a fluorine-free (meth)acrylate and also ethoxylated fatty acids or an oxime-blocked isocyanate, a fluorine-containing oligo- or polyurethane and also an ethoxylated fatty amine (salt). The agents lead to a pleasantly soft handle on the finished textile material and in many cases reduce the bleeding of dyed textiles.

12 Claims, No Drawings

AGENT FOR THE TREATMENT OF FIBRE MATERIALS

The invention relates to an agent for treating fibre materials which contains at least two components which have specific compositions. The invention further relates to the use of such agents for treating fibre materials.

It is known to treat materials which contain natural, regenerated or synthetic fibres with certain agents in order to confer certain desired properties on the materials, for example textiles. The fibre materials are normally present here in the form of sheetlike structures such as woven fabrics, knitted fabrics or nonwoven fabrics. The properties which are to be imparted to the fibre materials include in many cases, inter alia, a pleasantly soft handle and a water and/or oil repellent effect.

Water and oil repellent properties of textiles are frequently achieved using fluorine-containing polymers. This is described for example in U.S. Pat. No. 4,742,140 or in EP-A 0,325,918. According to the U.S. specification mentioned, the polymers used are copolymers formed from acrylates which contain perfluorinated groups, vinylidene chloride and (meth)acrylates as monomers. These copolymers can be used in the form of aqueous dispersions which contain ethoxylated fatty acids as emulsifiers. If textile sheet materials are treated with dispersions of copolymers as described in said U.S. patent, however, it is found to be disadvantageous that the effectiveness of the oil and water repellent effect is not satisfactory in every case. Moreover, the handle of the textiles thus finished is still not optimally soft.

Also, in the case of dyed textiles, the resistance of the dyeing to solvents in which the dye is soluble is inadequate. This is important as soon as the textiles come into contact with such solvents, for example in dry cleaning or in the use of protective work wear. It has been found that in these cases portions of the dye are dissolved out by the solvent; this is true in particular of disperse dyes in relation to acetone, perchloroethylene and methyl ethyl ketone as solvents. The disadvantage of inadequate solvent fastness properties arises not only in the case of finishing with copolymers as described in U.S. Pat. No. 4,742,140, but was also found with textiles to which an oil and water repellent finish was applied using other fluorine-containing products.

It is hence an object of the present invention to provide an agent for the highly effective oil and water repellent finishing of fibre materials which confers on the materials finished therewith a pleasantly soft fabric handle and which ideally additionally ensures that dyed materials finished therewith possess improved solvent resistance of the dyeing in particular also in relation to solvents such as acetone, perchloroethylene and/or methyl ethyl ketone.

This object is achieved by an agent as claimed in claim 1; preferred embodiments are revealed in subclaims.

It was found, surprisingly, that the combination of the components A) and B ) defined in claim 1, especially if component B1 ) is used, imparts to dyed fibre materials finished therewith excellent resistance of the dyeing to organic solvents, in particular to acetone, perchloroethylene and methyl ethyl ketone. This finding was surprising and unexpected for the person skilled in the art because, as shown below in the embodiment examples, neither component A) nor component B) on their own lead to satisfactory solvent fastness in every case. In addition, the agents according to the invention produce a softer handle on the finished fibre materials than components A) and B) alone.

The agents according to the invention impart to the fibre materials, such as textiles, finished therewith a pleasantly soft handle and very good oil and water repellent properties. The finish produced by these agents shows very good permanence to washing processes and to solvents. The aqueous dispersions of components A) and B) may include farther textile finishing agents, such as antistats, without adverse effect on the stability of the dispersions and the finish effects such as oil and water repellency or soft handle.

The agents according to the invention contain at least two components A) and B), which each constitute an aqueous dispersion. To obtain fully satisfactory effects in respect of solvent fastness of the dyeing, it is necessary that the weight ratio of component A) to component B) should be in the range from 30:70 to 70:30. Mixing ratios outside this range lead to less satisfactory results. The further the mixing ratio is away from the range according to the invention, the closer the results in respect of solvent fastness come to those which are obtained with the pure components A) and B) and which are not fully satisfactory. Of the agents according to the invention, particular preference is given to those in which the weight ratio of component A) to component B) is about 50:50. If the weight ratio is of this order of magnitude, the synergism between A) and B) is particularly pronounced.

To prepare agents according to the invention it is sufficient to mix the two dispersions (components A) and B)) with one another. Normally, the mixing need not be followed by further homogenisation.

Component A)

Component A) is an aqueous dispersion which contains at least the constituents a), b) and c) described hereinafter and may additionally contain further constituents. The constituents a), b) and c) are present in the following amounts:

a, 15 to 25 parts by weight b, 1 to 2 parts by weight c, 55 to 75 parts by weight.

Constituent a) is a copolymer formed from three monomers, namely a perfluoroalkylethyl acrylate or a perfluoroalkylethyl methacrylate, vinyl chloride and a fluorine-free alkyl acrylate or methacrylate. The perfluoroalkylethyl acrylate is present in an amount of from 50 to 60% by weight, vinyl chloride in an amount of from 2 to 10% by weight and the fluorine-free alkyl (meth)acrylate in an amount of from 30 to 40% by weight, the sum total of the individual weight percentages always being 100. The perfluoroalkylethyl acrylate is an acrylic ester of the formula $$CH_2{=}CH{-}COOCH_2CH_2{-}R_f$$

where $R_f$ is a branched or unbranched perfluoroalkyl radical of from 2 to 14 carbon atoms, or the corresponding methacrylic ester.

Preferably, $R_f$ is an unbranched radical of from 4 to 10 carbon atoms. For cost reasons, the perfluoroalkylethyl acrylate is not a uniform product but a mixture of compounds which differ in the chain length of the radical $R_f$. However, in at least 95% of all the compounds present in the mixture, the radical $R_f$ has from 2 to 14 carbon atoms; preferably, the majority of the individual molecules has an $R_f$ of from 4 to 10 carbon atoms.

The fluorine-free alkyl acrylate or methacrylate present as a monomer unit in the copolymer (constituent a) of component A) is an acrylic or methacrylic ester of an aliphatic straight-chain or branched alcohol having an alkyl chain of from 10 to 18 carbon atoms. As with the perfluoroalkylethyl acrylates explained above, the fluorine-free (meth)acrylate is normally also a mixture of esters which differ in the chain length of the alcohol component. However, in at least 95% of the individual molecules the chain length of the alcohol component is from 10 to 18 carbon atoms. The fluorine-free acrylate present as monomer unit in constituent a) is preferably n-octadecyl acrylate. The copolymers usable as constituent a) of component A) can be prepared from the monomers in a conventional manner, for example by emulsion polymerisation.

Constituent b)

Constituent b) of component A) is an ethoxylated alkylphenol of the formula $$R—C_6H_4—O(CH_2CH_2O)_p—H$$

The radical R is a branched or unbranched alkyl radical of from 4 to 12, preferably from 6 to 10, carbon atoms, which is preferably disposed para to the phenol oxygen. The value of p (degree of ethoxylation) is from 6 to 20, preferably from 10 to 16. As in the above-explained cases, constituent b) is normally likewise a mixture of compounds which differ in the length of the radical R and in the degree of ethoxylation. Such mixtures are commercially available products which are on the market inter alia as emulsifiers.

The third constituent c) of component A) is water.

Component B)

Component B) is either an aqueous dispersion B1 or an aqueous dispersion B2.

Component B1) is an aqueous dispersion which contains at least the constituents d), e) and f) described hereinafter and may in addition contain further constituents. The constituents d), e) and f) are present in component B1) in the following amounts:

d, 15 to 20 parts by weight
e, 1 to 2 parts by weight
f, 65 to 80 parts by weight.

Constituent d) is a copolymer formed from three monomers, namely a fluorine-containing acrylate, vinylidene chloride and a fluorine-free alkyl acrylate or alkyl methacrylate. The fluorine-containing acrylate is present in an amount of from 40 to 75% by weight, vinylidene chloride in an mount of from 10 to 35% by weight and the fluorine-free alkyl (meth)acrylate in an amount of from 10 to 25% by weight, the sum total of the individual weight percentages always being 100. The fluorine-containing acrylate has the general formula $$CF_3—CF_2—(CF_2)_k—CH_2—CH_2—OC(O)—CH=CH_2$$

In this formula, k can be from 1 to 12. The fluorine-containing acrylate present as monomer unit in the copolymer (constituent d)) need not be a uniform product but on the contrary is normally a mixture of products which fall under the abovementioned formula and differ in the chain length of the fluorinated radical, i.e. in the value of k. Of particular preference for the agents according to the invention are here fluorine-containing acrylates of the formula mentioned where in 0 to 10% of the monomers k is 4 or less,
in 45 to 75% of the monomers k is 6,
in 20 to 40% of the monomers k is 8,
in 1 to 20% of the monomers k is 10,
in 0 to 5% of the monomers k is 12.

As with the fluorine-containing acrylates, the fluorine-free alkyl (meth)acrylates will normally be present as monomer unit in the form of a mixture of compounds which differ in the chain length of the alkyl radical. But these compounds will always be compounds whose alkyl chain will contain from 2 to 18 carbon atoms. These alkyl chains can be branched or unbranched.

Copolymers which (as constituent d) of component B1 ) are suitable for preparing agents according to the invention are described in U.S. Pat. No. 4,742,140, which also describes processes for preparing such copolymers, for example by emulsion polymerisation.

Constituent e)

Constituent e) is a mixture of ethoxylated fatty acids which is obtainable in a conventional manner by reacting a mixture of fatty acids with ethylene oxide. Since for cost reasons the synthesis is normally performed using a mixture of fatty acids of different chain lengths, the products obtained represent a mixture of compounds which differ in the chain length of the fatty acid radicals and in the degree of ethoxylation. The agents according to the invention are based on mixtures of compounds whose fatty acid radicals have from 8 to 18, preferably from 12 to 18, carbon atoms and whose degree of ethoxylation is from 6 to 20, preferably from 10 to 16. The degree of ethoxylation is the average number of $—CH_2—CH_2—O—$ units attached to a fatty acid radical. Constituent e) acts as dispersant for constituent d).

Constituent f) of component B1) is water.

Suitable product mixtures which may be used as component B1) for preparing agents according to the invention are described in U.S. Pat. No. 4,742,140.

Instead of the above-described component B1) it is also possible to use the component B2) described hereinafter.

Component B2) is an aqueous dispersion which contains at least the constituents g) to k) described hereinafter, in the following mounts:

constituent g): 2 to 10 parts by weight
constituent h): 10 to 40 parts by weight
constituent i): 0.5 to 10 parts by weight
constituent k): 40 to 90 parts by weight Particularly favourable results are obtained when component B2) contains the following amounts of constituents g) to k):

g: 4 to 8 parts by weight
h: 10 to 25 parts by weight
i: 1 to 5 parts by weight
k: 50 to 80 parts by weight.

Constituent g) is an isocyanate blocked by means of an oxime, meaning that the —NCO groups of the underlying isocyanate have been blocked by reacting the isocyanate with an oxime R1R2C=NOH, where R1 and R2 are normally alkyl radicals of from 1 to 4 carbon atoms. "Isocyanate" here means products which contain at least one, preferably two or more, —N=C=O groups. Suitable underlying isocyanates are for example 2,2,4- or 2,4,4-trimethylhexamethylene diisocyanate or a mixture of these isomers. The underlying isocyanates are preferably aliphatic or cycloaliphatic di- or triisocyanates, or it is also possible to use polyisocyanates; polyisocyanates are products having more than three —N=C=O groups. At least 90, preferably 100% of the —N=C=O groups of the isocyanate are blocked by an oxime, preferably by an aliphatic oxime, i.e. an oxime of the formula R1R2C=NOH, where R1 and R2 are each independently of the other an alkyl radical of from 1 to 4 carbon atoms. A suitable oxime is for example butanone oxime. A suitable blocked isocyanate is Desmodur® L75 (from Bayer AG, DE). Further suitable blocked isocyanates are described in EP-196,309.

Constituent h) of component B2) is an oligo- or polyurethane whose diol-derived units contain substituents having perfluoroaliphatic groups. Such products are obtainable by reacting diols which contain perfluoroaliphatic groups with products which have at least two isocyanate groups. Suitable products and processes for preparing them are revealed in U.S. Pat. No. 3,968,066 and U.S. Pat. No. 4,054,592. Particular preference for use as constituent h) of the component B2) is given to products as described inter alia in EP-A 0,348,350. Similarly, the German Patent Applications bearing the file references P 40 16 329.6-44 (date of filing: May 21, 1990) and P 40 22 443.0 (date of filing: Jul. 14, 1990) describe products which are particularly preferred for use as constituent h). In the case of Patent Application P 40 22 443.0 this refers to the intermediates (prior to reaction with siloxane) which are obtained by reacting the diols mentioned therein with compounds which contain two or more —N=C=O groups. Products which are particularly suitable for use as constituent h) of component B2) of the agents according to the invention can be obtained by a) reacting a diol of the general formula I

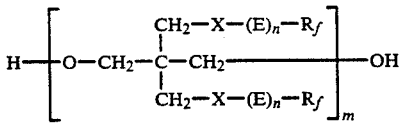

(I)

where m is 1, 2 or 3, n is 0 or 1, the unit —$CH_2$—X— is —$CH_2$—S—, —$CH_2$—N(R)—$SO_2$ or —$CH_2$—N(R)—C(O)—, where R is hydrogen or an alkyl group of from 1-6 carbon atoms, $R_f$ is a straight-chain or branched perfluoroalkyl radical of from 1 to 18 carbon atoms in which a fluorine atom may be replaced by a perfluoroalkoxy group of from 2 to 6 carbon atoms, and E is a branched or straight-chain alkylene radical of from 1 to 10 carbon atoms which may be interrupted by from 1 to 3 groups, namely by respectively divalent bridge members of the formula —NR—, —O—, —S—, —$SO_2$—, —COO—, OOC—, —CONR—, —NRCO—, —$SO_2$NR— and —NR$SO_2$—, and which may have at one end an —$SO_2$NR— or a —CONR— group, the radical $R_f$ being linked to the sulphur atom or the carbon atom of this group, and R is hydrogen or an alkyl group of 1-6 carbon atoms, which diol may be present in a mixture with by-products, obtained in its preparation, with an aliphatic, cycloaliphatic or aromatic di-, tri- or polyisocyanate, which reaction was carried out in the presence or absence of a chain extender which contains at least 2 hydroxyl groups. A suitable chain extender containing 2 hydroxyl groups is in particular N-methyldiethanolamine.

The products thus obtainable are notable for high effectivity being achieved in respect of oil and water repellency when textiles are finished with compositions which contain these products.

Constituent i) of component B2) is an ethoxylated fatty amine or the salt formed from such a fatty amine and an aliphatic monocarboxylic acid of from 1 to 4 carbon atoms. Suitable salts are described hereinafter in the section about component D). As regards constituent i) of component B2) the same salts are suitable as for component D), as well as the underlying ethoxylated fatty amines which have not been neutralised with a carboxylic acid.

Constituent k) of component B2) is water.

In a preferred embodiment, component B1) or B2) of the agents according to the invention additionally contains one or two further constituents l) and/or m), but no further constituents. Constituents l) and m) comprise from 5 to 10 parts by weight of acetone and from 2 to 6 parts by weight of ethylene glycol or 1,2-propanediol, respectively. These parts by weight are based on the abovementioned figures for the parts by weight of the constituents d), e) and f) on the one hand and g), h), i) and k) on the other.

Component A) likewise preferably contains a further constituent n), namely acetone in an amount of from 10 to 15 parts by weight, based on the abovementioned values for the parts by weight of the constituents a), b) and c). Preferably, component A) contains no further constituents other than a), b), c) and optionally n).

The parts by weight of the various constituents used in a particular case for components A) and B) and optionally C) and D) need not add up to 100 parts by weight (in contradistinction to weight percentages).

The agents according to the invention can be prepared by combining the two aqueous dispersions (components A) and B)) and be used in that form. However, in certain cases it is of advantage when still further products are added to the combined dispersions. In this way further special properties can be imparted to the fibre materials treated with the agents according to the invention. For instance, especially textile fibre materials may have imparted to them a still more pleasant handle if in addition to the components A) and B) the agents according to the invention also contain a component C) and/or a component D). In particular the simultaneous presence of the components C) and D) leads to very good effects.

Component C)

It comprises an aqueous dispersion which is a mixture of a polysiloxane which contains Si—H bonds, an ethoxylated alcohol and water. The polysiloxane in component C) is a polydimethylsiloxane in which some, normally less than 25%, of the Si—$CH_3$ bonds have been replaced by Si—H bonds. Such polysiloxanes are conventionally available products. Any such commercially available polysiloxane can be used for the agents according to the invention, provided the stability of the aqueous dispersion containing it meets the particular requirements. The ethoxylated alcohol contained in component C) has a degree of ethoxylation (average number of $CH_2CH_2O$— units) of from 4 to 12, preferably from 6 to 8. The underlying alcohol is an aliphatic alcohol having a branched or unbranched alkyl chain of from 6 to 16, preferably from 10 to 12, carbon atoms.

The third constituent of component C) is water.

Component C) contains from 30 to 40 parts by weight of polysiloxane, from 1 to 5 parts by weight of ethoxylated alcohol and from 60 to 65 parts by weight of water.

Component D)

Component D) likewise is a mixture in the form of an aqueous dispersion. This mixture contains a tetrasubstituted urea, a carboxylic acid salt of a fatty amine ethoxylate, ethoxylated ricinoleic acid and water. Component D) may in addition contain minor amounts, i.e. in each case up to 5 parts by weight (based on the weight particular mentioned hereinafter for component D)), of one or more of the following substances: ethylene glycol, methanol, acetic acid and isobutanol. The sum total of all the amounts of these substances present is accordingly not more than 20 parts by weight.

Component D) contains from 15 to 25 parts by weight of the tetrasubstituted urea, from 1 to 2 parts by weight of the carboxylic acid salt mentioned, from 1 to 2 parts by weight of ethoxylated ricinoleic acid, and from 60 to 75 parts by weight of water and also optionally in addition one or more of the abovementioned substances. The tetrasubstituted urea is a compound of the formula

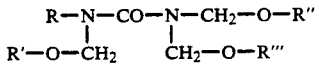

where R is an alkyl radical of from 12 to 18 carbon atoms and R', R'' and R''' are each independently of the others hydrogen or a straight-chain or branched alkyl radical of from 1 to 4 carbon atoms.

It thus comprises a trismethylolated N-alkylurea one, two or three methylol radicals of which may have been etherified. This urea may also constitute a mixture of compounds which differ in the chain length of one or more of the radicals R, R', R'' and R'''.

The carboxylic acid salt of a fatty amine ethoxylate contained in component D) can be obtained by ethoxylating a fatty amine and reacting the ethoxylation product with an equivalent amount of a carboxylic acid. The salt preferably has the formula $R_4—NH(R_6)^+—(CH_2CH_2O)_y—H+R_5COO^-$ where $R_4$ is an alkyl radical of from 10 to 18 carbon atoms, $R_5$ is an alkyl radical of from 1 to 4 carbon atoms, $R_6$ is hydrogen or $(CH_2CH_2O)_y$ and y is from 2 to 16. The salt present here is normally a mixture of salts which differ in the chain length of the radicals $R_4$ and $R_5$ and/or in the value of y. The radicals $R_4$ and $R_5$ can be branched, but they are preferably unbranched.

The ethoxylated ricinoleic acid contained in component D) has a degree of ethoxylation of from 2 to 12. Here too it is normal to have a mixture of compounds which differ in the degree of ethoxylation, i.e. in the number of $—CH_2—CH_2—O—$ units.

The agents according to the invention preferably contain the components A) to D) in a weight ratio of from 40 to 50% of A from 40 to 50% of B from 0 to 10% of C from 0 to 10% of D.

The agents according to the invention are aqueous dispersions which are highly suitable for conferring water and oil repellency on fibre materials, in particular textile sheet materials, and also good solvent fastness of the dyeing and a pleasantly soft handle. These textile sheet materials are preferably those which consist of cellulose fibres, for example cotton, or which contain cellulose fibres in a mixture with other fibres such as polyester fibres. The agents can be applied in a conventional manner, for example by padding, in amounts customary for textile finishing.

The invention will now be illustrated by embodiment examples.

The results were assessed on the basis of the following hereinafter described test methods:

Before the tests a to c were carried out, the samples were stored after finishing at 20° C. and 65% relative humidity for 24 hours.

a. The oil repellent effect was determined according to AATCC 118-1978. This involved examining the wetting effect of eight different liquid hydrocarbons; the rating scale of this test method measures from 1 to 8, of which rating 8 denotes the best result (the highest repellency effect).

b. The water repellent effect was tested not only to AATCC 22-1980 (spray test) but also to DIN 53888 (Bundesmann shower test). The latter test determines the water uptake in % by weight and provides a visual rating of the bead-off effect on a scale from 1 (worst result) to 5 (best result; water beads off without wetting). In the spray test the assessment is likewise visually on a scale range from 0 to 100 (100=best result, i.e. least wetting). The abovementioned AATCC test methods are taken from the "AATCC (American Association of Textile Chemists and Colorists) Technical Manual" vol. 58, 1983, pages 248, 270, 271.

c. The solvent fastness of dyeings was determined on dyed fabric samples by the following method (see brochure No. 7/84 dated June 1983 from Chemische Fabrik Pfersee, Augsburg, "Glass plate test for determining the bleed tendency of dyeings"): the dyed fabric sample to be tested is placed on top of a glass plate together with white filter paper in between the fabric and the glass plate. On top of the fabric is placed a second glass plate which has a small hole in the middle. Using a pipette about 0.2 ml of solvent (e.g. acetone or perchloroethylene) is applied to the fabric through this hole. After 60 seconds the filter paper is removed and dried at room temperature. The amount of dye on the filter paper (=measure of dye bled out of the fabric) is visually assessed.

EXAMPLE 1

Samples of a 100% polyester (Trevira® Finesse) microfibre fabric, which had been dyed blue, was finished with the hereinafter described liquors in a padding process. To this end the fabric samples were successively dipped, squeezed off, dipped and squeezed off. The liquor pick-up after the second squeeze-off was about 60% by weight. Then the samples were dried under tension on a frame (100°-120° C., 10 min) and condensed (150° C., 5 min).

Liquor 1 (according to the invention):

The liquor contained in 1 l of water:

1 ml of 60% acetic acid and 25 g of an approximately 20% strength aqueous dispersion which had been prepared by mixing the following individual products a to d:

a. an aqueous commercial dispersion (corresponding to the component B1) mentioned in claims 1 and 4) of a concentration of about 28%, which contained about 15% by weight of copolymer, 1–2 parts by weight of ethoxylated fatty acids, 7.5% by weight of acetone and about 4% by weight of ethylene glycol. The copolymer had the composition indicated in claim 1 (constituent d) of component B1)), the maximum chain length of the perfluoroalkyl radical being about 8 carbon atoms and the maximum alkyl chain length of the fluorine-free acrylate being about 16–18 carbon atoms.

b. a commercially available aqueous dispersion (corresponding to component A) of claims 1 and 7) which contained about 70 parts by weight of water, 10 parts by weight of acetone, 18 parts by weight of copolymer and 2% of ethoxylated (about 13–16 EO) alkylphenol (mainly 8 to 10 carbon atoms in the alkyl chain). The copolymer had the composition indicated in claim 1 (constituent a) of component A)), the monomers being approximately present in a weight ratio of 58:37:5 for perfluoroalkylethyl acrylate: fluorine-free acrylate (about 16–18 carbon atoms in the alkyl chain): vinyl chloride.

c. an aqueous dispersion which contained about 35% by weight of a mixture of a siloxane having Si—H bonds (a polydimethylsiloxane where some of the Si—$CH_3$bonds have been replaced by Si—H bonds) and an ethoxylated alcohol (on average from 10 to 12 carbon atoms with about 6 EO units) and 65% by weight of water. (The mixture mentioned corresponds to component C) of claim 10).

d. an aqueous dispersion which contained about 70% by weight of water and 30% by weight of a mixture as described above and in claim 10 as component D).

The mixing ratio in liquor 1 was such that the products a and b mentioned here (components A) and B 1) of claim 1) were used in approximately equal weight proportions and the sum total of a and b accounted for about 90% of the 20% aqueous dispersion while the constituents c) and d) each accounted only for amounts of less than 10%.

Liquor 2 (comparison, not according to the invention):

The liquor contained in 1 l of water:

1 ml of 60% acetic acid 25 g of product a) of liquor 1 (the products b, c and d of liquor 1 were not present).

Liquor 3 (comparison, not according to the invention):

Composition as for liquor 2 but with product b of liquor 1 (instead of product a).

Liquor 4 (comparison, not according to the invention):

As for liquor 3 but instead of product b another commercially available dispersion which, however, had a similar composition to that of product b, Liquor 5 (not according to the invention):

As for liquor 3 but instead of product b the commercial product Scotchgard ® FX 3563

Liquor 6 (according to the invention):

Composition as for liquor 1 but without products c) and d)

The finished and aftertreated fabrics were subjected to the spray test and the Bundesmann test (water uptake in % by weight and bead-off rating) and also to a determination of the oil repellent effect, in each case on the original sample, after 5 machine washes (domestic washing machine) at 40° C. and after a dry clean. The results are shown in Table 1. The bead-off effect is reported with 3 values each. They concern (in the stated order) assessments after 1, 5 and 10 minutes. In the case of the Bundesmann test according to DIN 53888 additionally (see Table 1 under c) the amount of water passing through the fabric was determined in ml. These values depend strongly on the density of the fabric structure. The lower these water passage values are for one and the same fabric, the better the water repellent effect is. The asterisked (*) value in Table 1 means that the fabric in question was completely wetted by the water (poor water repellency in the run-through test).

EXAMPLE 2

TABLE 1

| | (Results on Trevira$^R$ finesse fabric) | | | | | |
|---|---|---|---|---|---|---|
| | Liquor 1 | Liquor 2 | Liquor 3 | Liquor 4 | Liquor 5 | Liquor 6 |
| Oil repellent effect (rating) | | | | | | |
| Original | 5 | 5 | 5 | 5 | 5 | 5 |
| after 5 × 40° wash | 4 | 4 | 4 | 4 | 4 | 4 |
| after dry clean | 5 | 5 | 5 | 4 | 4 | 5 |
| Bundesmann, DIN 53888 | | | | | | |
| a) Water uptake (% by weight) | | | | | | |
| Original | 0.4 | 0.4 | 0.4 | 0.4 | 0.8 | 0.4 |
| after 5 × 40° wash | 7.1 | 5.9 | 9.6 | 5.9 | 2.5 | 5.4 |
| after dry clean | 3.5 | 0.8 | 8.8 | 6.6 | 6.2 | 1.3 |
| b) Bead-off effect (rating) | | | | | | |
| Original | 5,5,5 | 5,5,5 | 5,5,5 | 5,5,5 | 5,5,5 | 5,5,5 |
| after 5 × 40° wash | 4,4,4 | 4,4,4 | 4,4,4 | 4,4,4 | 5,5,5 | 4,4,4 |
| after dry clean | 5,5,5 | 5,5,5 | 4,4,4 | 4,4,4 | 5,5,5 | 5,5,5 |
| c) ml of water run through | | | | | | |
| Original | 2 | 2 | 2 | 2 | 2 | 2 |
| after 5 × 40° wash | 2 | 2 | 2 | 2 | 2 | 3 |
| after dry clean | 0 | 0 | 1 | 1 | 3*) | 1 |
| Spray test (rating) | | | | | | |
| Original | 100 | 100 | 100 | 100 | 100 | 100 |

TABLE 1-continued

| | (Results on Trevira$^R$ finesse fabric) | | | | | |
|---|---|---|---|---|---|---|
| | Liquor 1 | Liquor 2 | Liquor 3 | Liquor 4 | Liquor 5 | Liquor 6 |
| after 5 × 40° wash | 90 | 90 | 90 | 90 | 90 | 90 |
| after dry clean | 100 | 100 | 100 | 100 | 100 | 100 |

Using the liquors Nos. 3, 4 and 5 described under Example 1 fabric samples of dyed polyester microfibres (warp) and dyed viscose fibres (weft) were finished and aftertreated as described under Example 1. The following liquor 7 was used in addition:

Liquor 7 (according to the invention):

As for liquor 1, except that product a (component B1) of claim 1) was replaced by product e, a composition as per component B2) of claim 1. Product e was an aqueous dispersion which contained about (in % by weight) 73% of water, 3% of 1,2-propanediol, 2% of an acetate of a fatty amine ethoxylate (Marlowe® 5401 ), 7% of an isocyanate blocked with butanone oxime (Desmodur® L 75) and 15% of a urethane having perfluoroalkyl groups (corresponding to constituent h) of component B2).

The results are shown in Table 2.

TABLE 2

| | (Results on polyester/viscose union fabric) | | | |
|---|---|---|---|---|
| | Liquor 3 | Liquor 4 | Liquor 5 | Liquor 7 |
| Oil repellent effect (rating) | | | | |
| Original | 5 | 5 | 4 | 5 |
| after 5 × 40° wash | 4 | 3 | 3 | 4 |
| after dry clean | 5 | 4 | 4 | 5 |
| Bundesmann, DIN 53888 | | | | |
| a) Water uptake (% by weight) | | | | |
| Original | 11.9 | 11.2 | 24.1 | 7.8 |
| after 5 × 40° wash | 28.2 | 27.6 | 32.1 | 15.1 |
| after dry clean | 27.8 | 31.3 | 27.9 | 11.7 |
| b) Bead-off effect (rating) | | | | |
| Original | 5,5,4 | 5,5,4 | 4,3,2 | 5,5,5 |
| after 5 × 40° wash | 3,1,1 | 3,1,1 | 3,1,1 | 4,4,4 |
| after dry clean | 3,1,1 | 4,2,1 | 5,3,2 | 5,5,5 |
| c) ml of water run through | | | | |
| Original | 4 | 4 | 2 | 2 |
| after 5 × 40° wash | 1 | 2 | 3 | 3 |
| after dry clean | 1 | 9 | 3 | 2 |
| Spray test (rating) | | | | |
| Original | 90 | 100 | 100 | 100 |
| after 5 × 40° wash | 90 | 90 | 90 | 90 |
| after dry clean | 90 | 90 | 100 | 100 |

EXAMPLE 3

Test of solvent resistance of dyeing:

To this end, 100% polyester fabric samples which had been dyed with, respectively, 2.5% of Terasil Red 3 BL, 6% of Terasil Dark Blue RB and 7% Terasil Black LBS were treated with liquors as described in Example 1. Compared with the finishing and aftertreatment conditions specified above the following changes were made:

The liquors contained in 1 l of water not 25 g of the corresponding aqueous dispersions but 40 g, and the condensation was carried out not at 150° C. for 5 minutes but at 180° C. for 40 seconds. A dyed fabric sample which had not been finished with an aqueous liquor was also included in the test. After the above-described solvent fastness test had been carried out, the filter paper samples were examined visually against the following scale:

0 (best rating): no dye visible

1 : very little dye

2 : small but distinctly visible amount of dye

3 : medium amount of dye

4 : pronounced staining of filter paper

The solvents used for the test were acetone (Ac), perchloroethylene (Perc) and methyl ethyl ketone (MEK).

The results are shown in Table 3.

TABLE 3

| | (Determination of solvent fastness of dyeings) | | | | | |
|---|---|---|---|---|---|---|
| | Liquor 1 | Liquor 2 | Liquor 3 | Liquor 4 | Liquor 5 | not finished |
| Terasil Red | | | | | | |
| Ac | 0 | 0 | 2 | 1 | 2 | 3 |
| Perc | 0 | 0 | 0 | 0 | 0 | 2 |
| MEK | 0 | 1 | 2 | 1 | 2 | 2 |
| Terasil Black | | | | | | |
| Ac | 1 | 0 | 3 | 4 | 3 | 2 |
| Perc | 0 | 0 | 0 | 1 | 1 | 2 |
| MEK | 1 | 0 | 2 | 3 | 4 | 3 |
| Terasil Dark Blue | | | | | | |
| Ac | 0 | 3 | 3 | 2 | 4 | 3 |

We claim:

1. An agent for treating fibre materials, which comprises at least two components A) and B) in a weight ratio range of A):B) of from 30:70 to 70:30, of which component A) is an aqueous dispersion which comprises the following constituents a), b) and c):

a) from 15 to 25 parts by weight of a copolymer consisting essentially of the following monomers: from 50 to 60% by weight of a perfluoroalkylethyl acrylate or perfluoroalkylethyl methacrylate, from 2 to 10% by weight of vinyl chloride, from 30 to 40% by weight of a fluorine-free alkyl acrylate or methacrylate having an alkyl chain of from 10 to 18 carbon atoms, b) from 1 to 2 parts by weight of an ethoxylated alkylphenol having an alkyl chain length of from 4 to 12 carbon atoms and a degree of ethoxylation of from 6 to 20, c) from 55 to 75 parts by weight of water, and component B) is either an aqueous dispersion B 1) which comprises the following constituents d, e and f:

d) from 15 to 20 parts by weight of a copolymer consisting essentially of the following monomers:

40–75% by weight of fluorine-containing acrylates of the formula $$CF_3—CF_2—(CF_2)_k—CH_2—CH_2—OCO—CH=CH_2$$

where k is from 1 to 12, from 10 to 35% by weight of vinylidene chloride, from 10 to 25% by weight of an alkyl acrylate or alkyl methacrylate having an alkyl chain of from 2 to 18 carbon atoms, e) 1–2 parts by weight of a mixture of ethoxylated fatty acids, the fatty acids having from 8 to 18 carbon atoms and the degree of ethoxylation being from 6 to 20, f) from 65 to 80 parts by weight of water, or component B is an aqueous dispersion B2) which comprises the following constituents g) to k):

g) from 2 to 10 parts by weight of an oxime-blocked isocyanate, h) from 10 to 40 parts by of an oligo- or polyurethane whose diol-derived units contain substituents having perfluoroaliphatic groups, i) from 0.5 to 10 parts by weight, of an ethoxylated fatty amine or of the salt formed between the ethoxylated fatty amine and an aliphatic monocarboxylic acid of from 2 to 4 carbon atoms, k) from 40 to 90 parts by weight of water.

2. An agent according to claim 1, characterised in that the weight ratio of A:B is about 50:50.

3. An agent according to claim 1, characterised in that in constituent a) of component A) the fluorine-free alkyl acrylate or methacrylate is octadecyl acrylate.

4. An agent according to claim 1, characterised in that the perfluoroalkylethyl acrylate of constituent a) of component A) is a mixture of compounds of the formula $$CF_3-(CF_2)_x-CH_2-CH_2-O-CO-CH=CH_2$$

where x is from 3 to 9.

5. An agent according to claim 1, characterised in that constituent g) of component B2) is an aliphatic or cycloaliphatic di- or triisocyanate whose isocyanate groups are blocked by an aliphatic oxime.

6. An agent according to claim 1, wherein the ethoxylated alkylphenol in constituent b) has an alkyl chain length of from 6 to 10 carbon atoms and a degree of ethoxylation of from 10 to 16.

7. An agent according to claim 1, wherein the fatty acids in constituent e) have from 12 to 18 carbon atoms and a degree of ethoxylation from 10 to 16.

8. An agent according to claim 1, wherein the oxime-blocked isocyanate in constituent g) is present in aqueous dispersion B2) in an amount of from 4 to 8 parts by weight.

9. An agent according to claim 1, wherein the oligo- or polyurethane in constituent h) is present in aqueous dispersion B2) in an amount of from 10 to 25 parts by weight.

10. An agent according to claim 1, wherein the ethoxylated fatty amine or salt in constituent i) is present in aqueous dispersion B2) in an amount of from 1 to 5 parts by weight.

11. An agent according to claim 1, wherein the water in constituent k) is present in aqueous dispersion B2) in an amount of from 50 to 80 parts by weight.

12. An agent according to claim 1, characterised in that in the fluorine-containing acrylates, which constitute 40–75% of the copolymer d) and which in turn constitutes from 15 to 20 parts by weight of the aqueous dispersion B1), the total percentage of the monomers present in the fluorine-containing acrylates comprise between 0 to 10% of monomer molecules where k is 4 or less, between 45 to 75% of monomer molecules where k is 6, between 20 to 40% of monomer molecules where k is 8, between 1 to 20% of monomer molecules where k is 10, and between 0 to 5% of monomer molecules where k is 12.

* * * * *